US007528717B2

(12) United States Patent
Benjelloun et al.

(10) Patent No.: US 7,528,717 B2
(45) **Date of Patent: *May 5, 2009**

(54) TAMPER DETECTION MECHANISM FOR BLIND INSTALLATION OF CIRCULAR SENSORS

(75) Inventors: Faycal Benjelloun, Great Neck, NY (US); Wen-Hua Hsu, Forest Hills, NY (US); Fred Katz, Hauppauge, NY (US)

(73) Assignee: Honeywell International Inc., Morristown, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/452,641

(22) Filed: Jun. 14, 2006

(65) Prior Publication Data

US 2007/0290845 A1 Dec. 20, 2007

(51) Int. Cl.
*G08B 13/14* (2006.01)

(52) U.S. Cl. ..... 340/568.1; 340/539.31

(58) Field of Classification Search ..... 340/568.1, 340/521, 571, 507, 539.31
See application file for complete search history.

(56) References Cited

U.S. PATENT DOCUMENTS 4,092,641 A * 5/1978 Bellinghausen et al. ..... 340/521
5,266,920 A * 11/1993 Langner ..... 340/571
5,341,124 A * 8/1994 Leyden et al. ..... 340/568.8
6,016,677 A 1/2000 Clark
6,570,502 B2 * 5/2003 Matsuo ..... 340/568.1
6,686,841 B1 * 2/2004 Busch et al. ..... 340/571
6,906,626 B2 * 6/2005 Novotny ..... 340/545.1
6,943,691 B2 * 9/2005 Chambers ..... 340/628
6,956,479 B2 * 10/2005 Kelsch et al. ..... 340/568.1
7,167,092 B2 * 1/2007 Higashiyama et al. ... 340/568.1
7,170,403 B2 * 1/2007 Noguchi ..... 340/507
2003/0227766 A1 12/2003 Hom et al.
2005/0140496 A1 6/2005 Magner et al.
2007/0040674 A1 * 2/2007 Hsu ..... 340/539.31

* cited by examiner

*Primary Examiner*—John A Tweel, Jr.
(74) *Attorney, Agent, or Firm*—Scully, Scott, Murphy and Presser, P.C.

(57) ABSTRACT

A tamper detection mechanism in a sensor device comprising a body and a mounting base. The sensor device includes a substantially central resilient element/plunger attached to the mounting base. The body houses a printed circuit board includes a surface for mating to the resilient element to create a circuit. The mounting base may be removably affixed to a structure such as a wall or ceiling. When the mounting base is screwed into the structure and the body is coupled to the mounting base, the plunger is compressed and exerts a continuous pressure on the printed circuit board surface to complete the tamper circuit. If the sensor device is uncoupled and/or removed from the structure, the circuit is opened and a tamper indication signal is produced.

15 Claims, 6 Drawing Sheets

TAMPER DETECTION MECHANISM FOR BLIND INSTALLATION OF CIRCULAR SENSORS

FIELD OF THE INVENTION

The invention relates to a tamper detection mechanism in a sensor device comprising a body and a mounting base, and more particularly, a tamper detection mechanism which includes a substantially central resilient element/plunger attached to a mounting base and adapted to create a circuit with a mating surface of a printed circuit board in a body portion of the sensor device.

BACKGROUND OF THE INVENTION

There are problems in the design of a tamper device for security sensors and for example, a round-shaped security sensor, such as a smoke detector, heat sensor or carbon monoxide sensor. Typically, a miniature switch is used to detect if the sensor has been opened. This switch has to activate when the body of the sensor is inserted and rotated into the mounting base to secure it and de-activate upon opening the sensor. After a few years, when the sensor is disassembled, the switch can fail to release and not annunciate that a tamper attempt has occurred. This could be due to, for example, vacuum, friction, spring, or material distortion. Known are sensor devices that include switches that have soft tops. However, in these designs, friction can cause distortion of the soft top when rotating the sensor during installation, and thus, a separate actuator is needed. The separate actuator complicates the design and additionally, the actuator is susceptible to establishing a "set position" (a normal position caused by material deformation, not by design) so that it may not release and as a result may cause a malfunction after a long duration of non-use.

A problem with conventional switches in known sensor devices is that large areas of a circuit board are required to be unpopulated, and complexity in the printed circuit board cover's topology, which increases size and cost and lessens product reliability.

Other known sensor devices require careful alignment of locating slots and tabs, with visual cues being required to complete the installation. One device requires aligning two tabs into slots, positioning the tabs, and then rotating part of the sensor device. In this case, if alignment is incorrect, the sensor could be damaged. Another known design for a sensor device to indicate tampering includes a switch mounted on a circuit board. The pressure of an actuating boss surface on the mounting plate retains the switch in an activated state. A common problem with this type of device is that pressure sensitive switches have a tendency to freeze in the closed position after being subject to being in the closed position for a length of time. This is due to an effect within the switch caused by a vacuum being formed with the internal disc-spring, or due to materials taking a "set position", caused by the perpetually closed position. These switches are designed to work properly when normally open and occasionally closed, whereas tamper functions require the switch to perform the opposite of this.

When installing circular packaged sensors, such as a carbon monoxide, smoke or heat detectors that are permanently affixed to the wall or ceiling, the sensor is initially installed by a security system installer, and is removed from time to time by an end-user for battery replenishment. A disadvantage of current sensors with tamper indicating mechanisms is that it is difficult to replace the sensor to the mounting base after the necessary service has been completed. Previous products required aligning two tabs into slots and very carefully guiding them into position and then rotating them. If alignment was not done correctly, it was possible to damage the plastic of the unit.

Other switches that may be applicable for indicating tampering have an actuating plunger with a high surface kinetic friction, due to actuator shape, actuator finish and actuator material. However, the motion necessary to secure the body of the sensor to the mounting plate housing requires a clockwise rotation, and when the switch actuator contacts the activating cam on the housing there is heavy rotational stress due to the friction. The switch can be damaged as a result of the stresses introduced by the frictional shear force perpendicular to the switch's operating axis. The friction also makes the sensor hard to mount as it acts as an additional drag on the rotation.

Other sensor device designs counteract frictional stresses by using an actuating finger molded into the plastic. This finger rides up with a cam and produces a longitudinal force onto a switch's actuating plunger to assist in the switch closure. Unfortunately, depending on the design of this finger and the choice of materials, there could be a tendency for the plastic to cold-form over time and retain a permanent "set position". This "set position" keeps the switch compressed when the sensor is disassembled.

It would therefore be desirable for a sensor device to signal tampering, and to be easy to install, and to simplify battery replenishment by an end-user. More specifically, it would be desirable for a sensor device to be mounted to a base without visually aligning any tabs or appurtenances and requiring a simple locking mechanism. It would further be desirable for a sensor device to have a tamper detection mechanism which would not be subject to "set positions" after a long period of time.

SUMMARY OF THE INVENTION

The invention relates to a tamper detection device for use in a sensor device in a dwelling or other building structure which comprises a mounting base including an electrical contact element. A body is detachably coupled to the mounting base and defines a body cavity. The body cavity houses a power source and a printed circuit board (PCB) powered by the power source. A resilient element is substantially centrally located on the mounting base and includes a contact element on a distal end thereof adapted to matingly contact an electrical element on the PCB creating a circuit when the body and the mounting base are coupled together. The electrical element on the PCB and the mating electrical contact disconnect when the mounting base and the body are uncoupled. Then, the PCB senses an open circuit condition as a tampering and initiates a tamper signal.

In a related aspect, the contact element on the distal end surface of the resilient element mates with a plurality of electrically conductive elements on a substantially central contact surface on the PCB.

In a further related aspect, the body and the mounting base are coupled together and coupled to a structure. The electrical element on the PCB and the mating electrical contact disconnect when the mounting base and the body are uncoupled or the mounting base and the body are removed from the structure as a unit. Then, the PCB senses an open circuit condition as a tampering and initiates a tamper signal.

In another related aspect, the body component includes a mounting structure adapted to hold the PCB and bias the PCB away from the resilient element such that when removing the coupled body and mounting base from the structure an open circuit condition occurs.

In a further aspect of the present invention, a tamper detection device for use in a sensor device in a dwelling or other building structure comprises a base component of the sensor device adapted to detachably couple to an interior structure. The base component including a substantially central resilient element including an electrically conductive contact element on a distal end surface. A body component of the sensor device including a printed circuit board (PCB) and a power source connected to the PCB. The body component and base component being adapted to detachably couple. The PCB having a substantially central electrical element adapted to engage with the contact element of the resilient element creating a circuit when the body component and the base component are coupled. Thus, when the body and base components are uncoupled an open circuit condition occurs indicating a tampering of the device to the PCB which initiates a tamper signal. The body component includes a mounting structure adapted to hold the PCB and bias the electrical element of the PCB away from the contact element of the resilient element. Thus, when the coupled body and base component are removed from the interior structure, the contact element of the resilient element and the electrical element of the PCB disengage, and an open circuit condition occurs indicating the tampering to the PCB which initiates the tamper signal.

In a related aspect, the substantially central resilient element extends substantially perpendicular to an interior surface of the base component.

In another related aspect, the signal includes a sound.

In another related aspect, the signal includes a wired or wireless communication to a receiving device, and the receiving device may be remote.

In another related aspect, the distal end surface is substantially perpendicular to a longitudinal axis along the resilient element.

In another related aspect, the contact element on the distal end surface of the resilient element mates with a plurality of electrically conductive elements on a contact surface on the PCB.

In a further aspect of the present invention a method of detecting a tampering of a sensor device in a dwelling or other building structure comprises providing a base component of the sensor device adapted to detachably couple to an interior structure. A body component of the sensor device is provided which includes a printed circuit board (PCB) and a power source connected to the PCB. An electrical circuit is provided when a substantially central contact element of the base component and a substantially central electrical element of the PCB engage each other. The contact element and the electrical element are engaged such that when the base component and the body component are uncoupled the contact element and the electrical element disengage from each other and an open circuit occurs. The open circuit is detected using the PCB, and a tamper occurrence is signaled when the open circuit is detected.

In a related aspect, the contact element and the electrical element are biased away from each other such that when the base component and body component are removed from the interior structure in a coupled state, the contact element and the electrical element disengage from each other resulting in an open circuit. The tamper signal may be received at a remote location, and may be transmitted wirelessly.

DETAILED DESCRIPTION OF THE INVENTION

Figure 1:
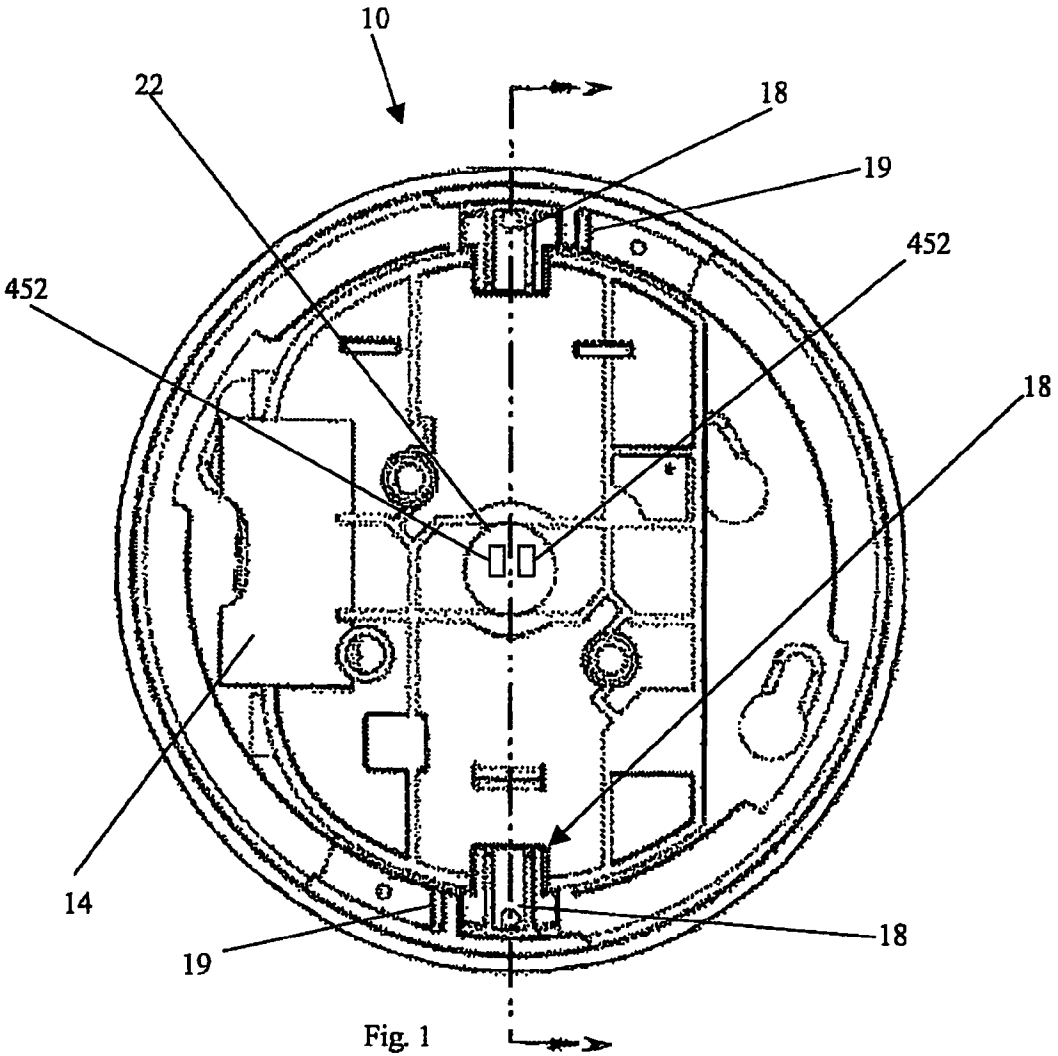
FIG. 1 is a plan view of the bottom of a detachable body of a sensor device.

The tamper detection device according to the present invention acts as a switch for detecting when a sensor device has been opened. The tamper detection device can also detect if the sensor device is removed from a wall or ceiling. According to the present invention, the tamper detection device is located at the center of rotation of the sensor device, so that there are no frictional side-thrust loads which can cause damage and malfunction to the mechanism during rotation. This assures proper activation/de-activation over the life of the product. The present invention enables blind assembly of the body and mounting base of an example circular-housed sensor, independent of any required angular alignment, and a simple rotation until locked. This is especially desirable for an installer on a ladder, without good visibility.

The sensor device 500 according to the present invention allows an exemplary circular packaged sensor, such as a carbon monoxide, smoke or heat detector, to be easily installed into its' mounting base, which is permanently affixed to the wall or ceiling. The sensor is initially installed by a security system installer, and is removed from time to time by an end-user for battery replenishment. It is necessary for it to be easy to replace the sensor to the mounting base after the necessary service has been completed.

The embodiment of the present invention, depicted in FIGS. 1-6, allows the sensor to be placed against the mounting base without visually aligning any tabs or appurtenances and requires a simple clockwise rotation to lock it in position. In the present invention, the tamper detection resilient element/plunger 400, is preferably installed into the center of the base 100. When the base 100 is rotated into its' mounting surface, the plunger 400 is compressed which forces it in the direction opposite to the mounting surface. The plunger is compressible, so that when the sensor is attached to the mounting base 100, the plunger compresses inward, which assures a continuous pressure of the contact disk 117 on the end of the plunger 400 with the printed circuit board electrically conductive pads 452, which completes the tamper circuit.

Figure 2:
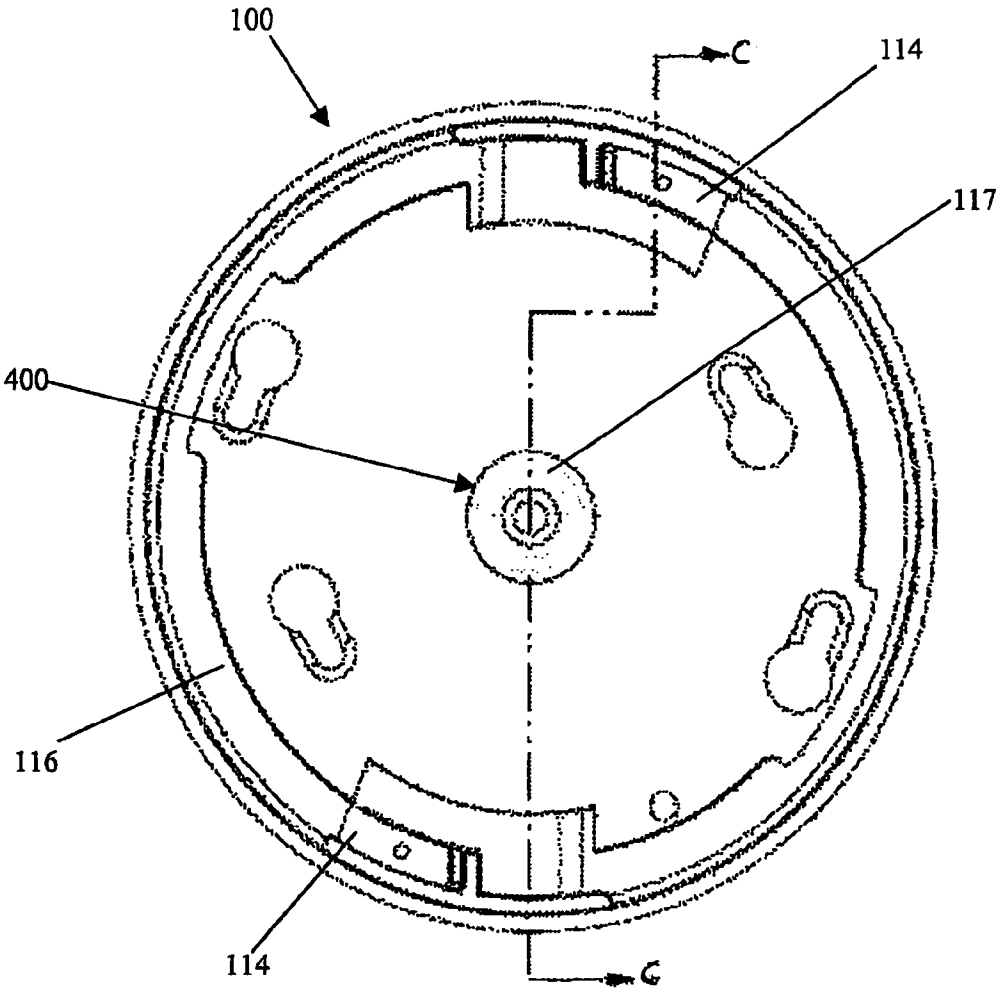
FIG. 2 is a plan view of a mounting base corresponding to the body of the sensor device shown in FIG. 1.
Figure 3:
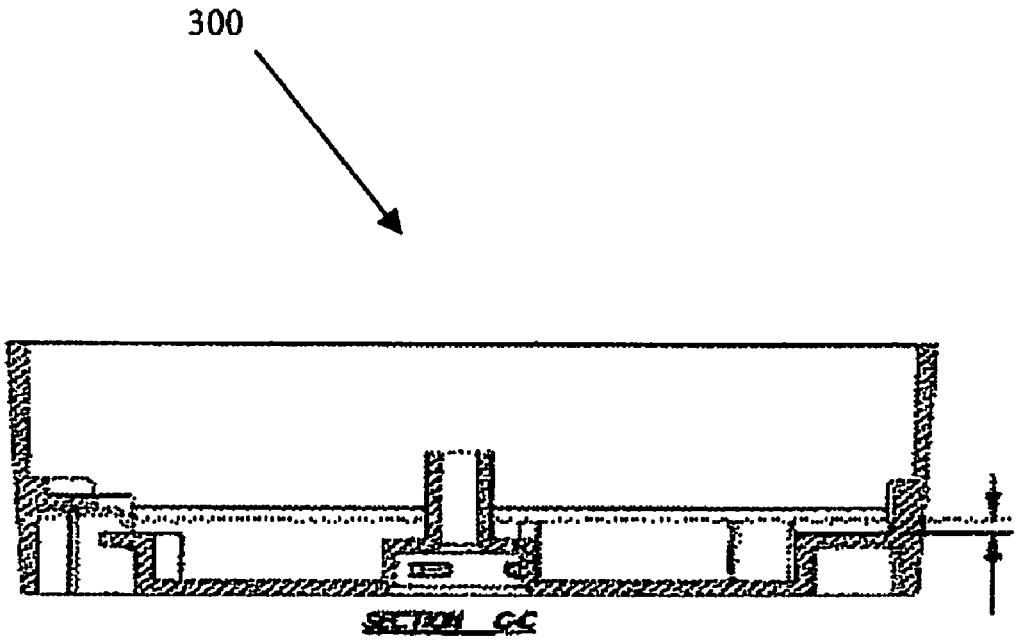
FIG. 3 is a cross sectional side elevational view of the mounting base taken along line CC shown in FIG. 2.

An embodiment of the sensor device body 10 and mounting base 100 according to the present invention is shown in FIGS. 1 and 2. The sensor device body 10 is circular and can be blindly placed against its' mating circular mounting base 100 and rotated until locked, without the need for viewing or alignment of tabs or locating structure to secure the body 10 to the mounting base 100. The body 10 includes a battery compartment 14 for housing a battery which provides power to a printed circuit board (PCB) and associated circuitry for detecting a tamper situation and producing a signal according to the detection mechanism, which may be a smoke, or carbon monoxide, etc., detection mechanism. Further, when tampering is detected, the battery provides power to a signal means for emitting a signal which may include, for example, a siren, or a wireless transmission. Tabs 18 are positioned on opposite sides of the body 10 and are adapted to matingly slide under the elements 114 on the bottom of the mounting base 100. The tabs 18 and elements 114 comprise a locking mechanism for removable coupling the body 10 and mounting base 100 together.

Figure 5:
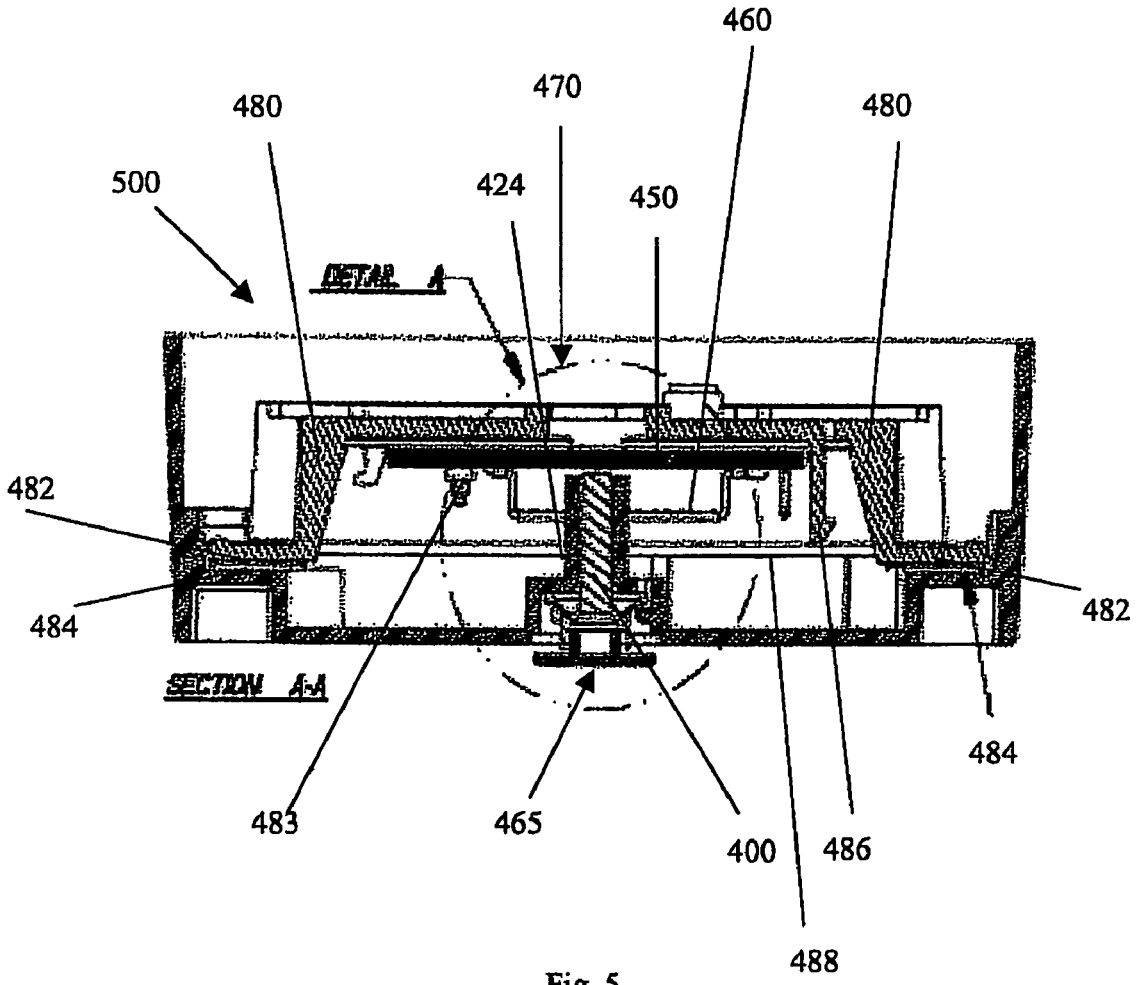
FIG. 5 is a cross sectional side elevational view of the sensor device, the body and mounting base as a unit, taken along line AA shown in FIG. 1 showing a detailed view "A" of the plunger and printed circuit board.
Figure 6:
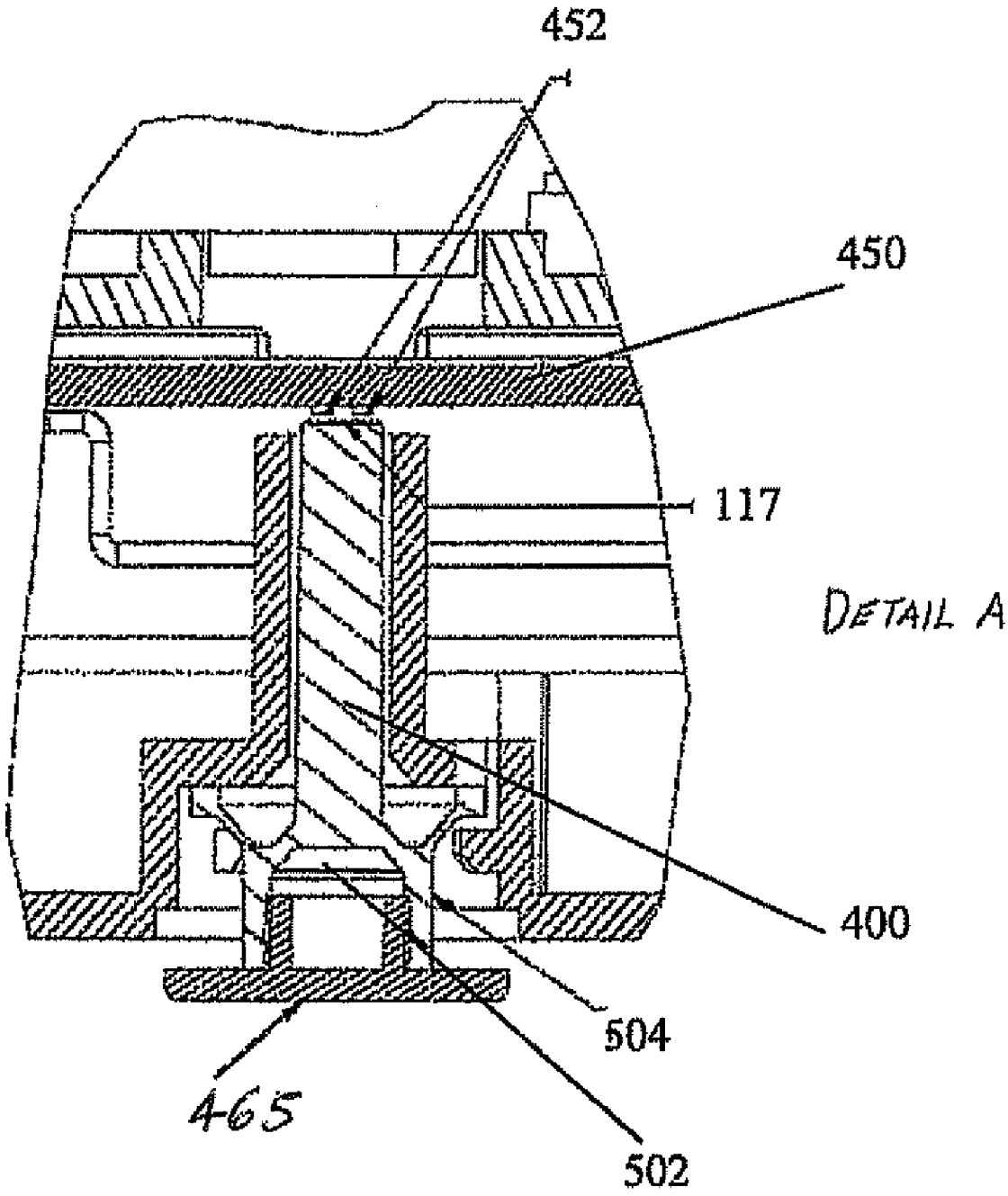
FIG. 6 is a cross sectional, side elevational detail view at "A" in FIG. 5 depicting the plunger and conductive pads on the printed circuit board.

Contact surface 22, shown in FIG. 1, on the body 10 is an exposed part of the PCB 450 (shown in FIG. 5) and includes electrically conductive pads 452. Referring to FIG. 5, the PCB 450 is protected by a printed circuit board cover 460. The printed circuit board 450 is a sub-assembly that is mounted to a heat detector (not shown) in the body 10 of the sensor unit 500. The heat detector, printed circuit board 450 and printed circuit board cover 460, and the screws 483 that hold the printed circuit board to the heat detector are a sub-assembly housed in the body 10 of the sensor device 500. The sub-assembly as part of the body 10 is placed against the mounting base 100 and rotated to lock the sub-assembly into the mounting base which has been fastened to a mounting surface, e.g. a ceiling or a wall.

Referring to FIG. 2, the resilient element 400 is substantially centrally located on the mounting base 465. The contact disk 117 of the resilient element 400 (shown in FIGS. 2 and 6) mate with the printed circuit board 450 contact surface 22 pads 452 (shown in FIGS. 1 and 6). The resilient element 400 and the locking mechanism comprising the tabs 18 and the elements 114 are independent of the initial orientation of the body 10 and the mounting base 100. During assembly, the body 10 overlays the base 100 and the tabs 18 are positioned adjacent to the elements 114. The body 10 and the mounting base 100 lock into position by two outward tabs 18 on the sensor device body 10 rotating along a circular raised surface 116 within the mounting base 100. The body is then twisted in a clockwise direction to slide the tabs 18 under the element 114 thereby locking the body 10 to the base 100 as a unit, as in sensor device 500 (shown in FIG.5). Eventually, portions 19 of the tabs 18 abut stops 119 on the mounting base 100 at the end of the rotation. Above the stops is a retaining ledge for holding the two tabs securely. The locking tabs 18 of the sensor body 10 can be aligned blindly, without extensive adjustment, and twisted until the body of the sensor locks to the base.

Resilient element/plunger 400 (shown in FIG. 5) is resilient and extends through shaft 424 and terminates at end 504. The shape is determined by a combination of factors including the initial memory of the molded elastomeric product, whether a mounting surface (e.g. a wall or ceiling) is pushing up against it, and the force of the printed circuit board pressing back and resilient plunger 400. The shaft 424 maintains the plunger 400 perpendicular to the circuit board 450 to ensure that the end 504 remains at the shaft's bottom while the distal contact disk 117 contacts the pads 452 on the contact surface 22 of the circuit board 450 completing the tamper circuit.

Referring to FIG. 5, a mounting structure/bracket 480 is connected to the body 10 of the sensor device 500. The mounting bracket 480 has the printed circuit board (PCB) affixed to it. There are two dropped arms 482 which rotate into the seat 484 locking the mounting bracket 480 and PCB to the wall mounting base 100. The bracket suspends the PCB at the correct level and also serves as a mounting surface for the heat detector module. Screws 483 go through the PCB, making contact with the PCB and fasten the PCB to the mounting bracket 480 through the threaded holes in the heat detector.

There is electrical contact via the two fastening screws 483, between the PCB 450 and the heat detector. When there is a thermal alarm, there is the equivalent of an electrical switch closure at the two threaded holes in the heat detector, which contacts the PCB through the screws. The circuitry on the PCB 450 interprets that switch closure as an alarm situation and sends out a suitable message.

Further, referring to FIG. 5, the mounting structure 480 is secured by arm 482 to the seat 484 on the body 10. Stop arm 486 contacts plate 488 to prevent the mounting structure 480 from over compressing and damaging the PCB 450 or contact 117 on the plunger 400. The mounting structure 480 is biased outwardly such that the coupling of the mounting base 100 and body 10 as a unit on a structure, e.g., a wall or ceiling, pushes the PCB 450 toward the contact disk 117 on FIG. 6 on the end of the plunger 400. If the sensor device 500 as a unit is removed from the structure, the natural bias of the mounting structure 480 pulls the PCB away from the contact disk 117 at the end of the plunger 400, thus, the circuit is opened which the PCB senses as a tampering. The present invention satisfies the need for a front tamper indication, when the body 10 and the mounting base 100 of the sensor device 500 is removed, but also serves as a rear tamper indicator if the entire sensor unit 500 is pried from the mounting surface.

Figure 4:
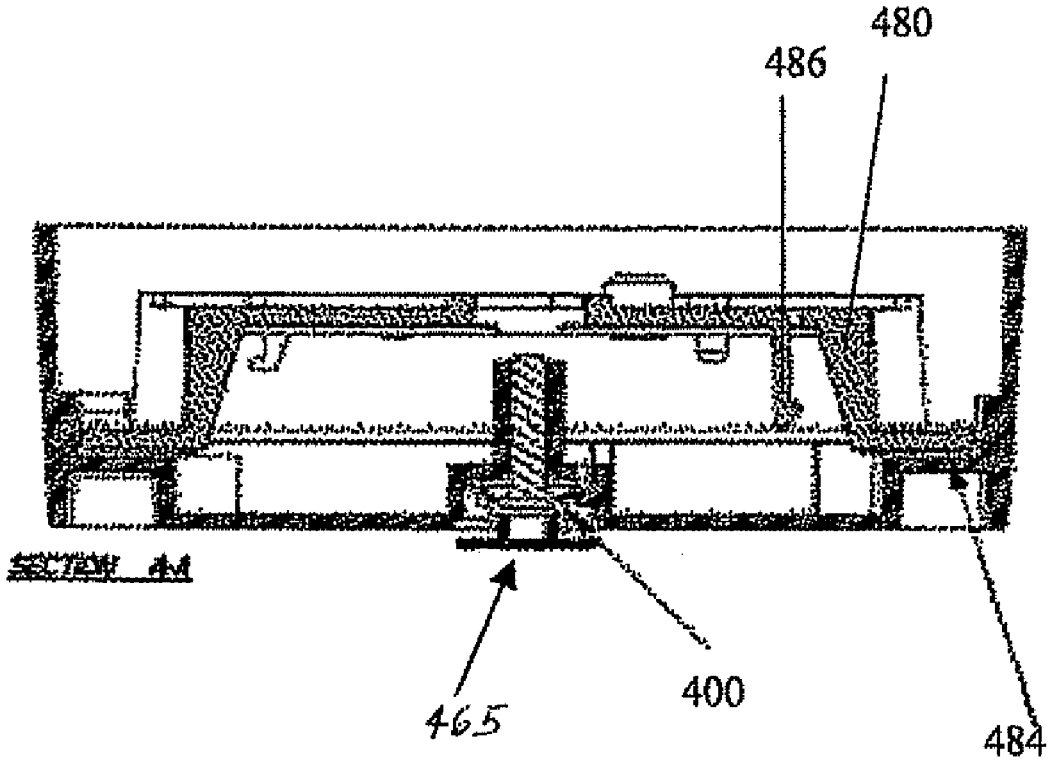
FIG. 4 is a cross sectional side elevational view of the sensor device, the body and mounting base as a unit, taken along line AA shown in FIG. 1.

The tamper detection device shown in FIGS. 4 and 5, includes a tamper detection plunger 400 preferably made of an elastomeric material, such as rubber, and is shaped into the form of a plunger. On one end are necessary grooves and appurtenances required to fix the device to a backing or mounting plate 465 on the mounting base 100. On the other end of the tamper detection plunger/device 400 is the centrally located conductive contact disk 117 that is used to complete the circuit of the two adjacent electrically conductive pads 452 (shown in FIG. 6) on the PCB 450.

More specifically, the resilient element/plunger 400 is inserted into the mounting base 100 and snapped into the backing or base portion 465 using a circular depressed retainer groove located along the length of the resilient element perpendicular to the cylindrical axis of the element. A proximal part 504 of the resilient element 400 protrudes behind the base portion 465 and is compressed when the mounting base 100 is pushed up against the mounting surface (e.g., wall or ceiling).

The compression of the resilient element/plunger 400 causes the element to extend further inward, eventually contacting the printed circuit board 450 which completes the circuit. There is over-travel designed into the resilient element/plunger 400, which ensures positive pressure against the printed circuit board 450, so that the conductive element 117 at the end of the resilient element/plunger 400 contacts both electrically conductive pads 452 (shown in FIGS. 1 and 6) on the printed circuit board 450 which completes the tamper circuit.

Over-travel, in this case, occurs when the resilient element 400 would extend beyond the normal mounting plane of the printed circuit board if the PCB were not present in the body 10. Thus, under normal operating conditions when the PCB 450 is in place in the body 10, the resilient element/plunger 400 exerts a positive pressure against the printed circuit board 450 contact surface 22 resulting in contact resistance between the two printed circuit electrically conductive pads 452 on the contact surface 22 of the tamper circuitry when the pads 452 are bridged by the contact disk 117 at the end of the resilient element 400.

The resilient element 400 is compressed by the force of the mounting surface against the mounting base 100 which pushes the mounting base 100, and thereby the resilient element, toward the PCB 450 affixed in the body 10. While the force against the mounting surface and the resulting application of pressure against the PCB continues, the resilient element remains locked into its' hole in the mounting base because the groove in the mounting base has a diameter approximately the diameter of the hole that it is inserted into, and on either side of the groove, the diameter is larger which results in a retention of the resilient element in the hole. The resilient element can easily be forced into the hole during manufacture because the element is resilient, and snapped into position.

When the body 10 and the mounting base 100 are assembled as a unit (as shown in FIG. 5), the contact disk 117 completes the circuit of the adjacent pads 452 and acts as a switch. If the sensor device 500 is disassembled, the circuit is opened electrically which is interpreted as a "tamper" condition. When a tamper condition is sensed by the PCB, wireless circuitry, for example, may transmit a message indicating tampering. Also, for example, a sound may be emitted or a light, or all of the indicators together.

A wireless transmission according to an embodiment of the present invention may include a custom integrated circuit, such as an RF-Encoder, which senses when a tamper situation has occurred. The RF-Encoder sends two signals to a transmitter circuit. One signal from the Encoder powers up an oscillator which is running at the selected transmitter frequency. This stays engaged until the full message is sent. The other signal from the RF-Encoder, switches power amplifier circuitry on and off, forming a burst transmission of pulses. These pulses are received by a receiver that decodes the digital message sent. To ensure a satisfactory transmission, there are multiple redundant transmissions of the same data. In addition to housekeeping data for the product, tamper and alarm data, a relatively unique serial number is transmitted which identifies which unit is transmitting. This is transmitted from the RF Amplifier through a small antenna within the unit.

An alternative to wireless transmission, is replacing the wireless transmitter radio with "hard wiring" which would route the wires to the alarm system's control panel.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. A tamper detection device for use in a sensor device in a dwelling or other building structure, which comprises:

a mounting base, the mounting base including an electrical contact element;

a body detachably coupled to the mounting base and defining a body cavity, the body cavity housing a power source and a printed circuit board (PCB) powered by the power source;

a resilient element substantially centrally located on the mounting base and including a contact element on a distal end thereof adapted to matingly contact an electrical element on the PCB creating a circuit when the body and the mounting base are coupled together, and the electrical element on the PCB and the mating electrical contact disconnect when the mounting base and the body are uncoupled and the PCB senses an open circuit condition as a tampering and initiates a tamper signal.

2. The device of claim 1 wherein the contact element on the distal end surface of the resilient element mates with a plurality of electrically conductive elements on a substantially central contact surface on the PCB.

3. The device of claim 1 wherein the body and the mounting base are coupled together and coupled to a structure, and the electrical element on the PCB and the mating electrical contact disconnect when the mounting base and the body are uncoupled or the mounting base and the body are removed from the structure as a unit and the PCB senses an open circuit condition as a tampering and initiates a tamper signal.

4. The device of claim 3 wherein the body component includes a mounting structure adapted to hold the PCB and bias the PCB away from the resilient element such that when removing the coupled body and mounting base from the structure the open circuit condition occurs.

5. A tamper detection device for use in a sensor device in a dwelling or other building structure, which comprises:

a base component of the sensor device being adapted to detachably couple to an interior structure, the base component including a substantially central resilient element including an electrically conductive contact element on a distal end surface;

a body component of the sensor device including a printed circuit board (PCB) and a power source connected to the PCB, the body component and base component being adapted to detachably couple, the PCB having a substantially central electrical element adapted to engage with the contact element of the resilient element creating a circuit when the body component and the base component are coupled such that when the body and base components are uncoupled an open circuit condition occurs indicating a tampering of the device to the PCB which initiates a tamper signal; and the body component including a mounting structure adapted to hold the PCB and bias the electrical element of the PCB away from the contact element of the resilient element such that when removing the coupled body and base component from the interior structure the contact element of the resilient element and the electrical element of the PCB disengage and the open circuit condition occurs indicating the tampering to the PCB which initiates the tamper signal.

6. The device of claim 5 wherein the substantially central resilient element extends substantially perpendicular to an interior surface of the base component.

7. The device of claim 5 wherein the signal includes a sound.

8. The device of claim 5 wherein the signal includes a wired or wireless communication to a receiving device.

9. The device of claim 8 wherein the receiving device is remote.

10. The device of claim 5 wherein the distal end surface is substantially perpendicular to a longitudinal axis along the resilient element.

11. The device of claim 5 wherein the contact element on the distal end surface of the resilient element mates with a plurality of electrically conductive elements on a contact surface on the PCB.

12. A method of detecting a tampering for use in a sensor device in a dwelling or other building structure comprising:

providing a base component of the sensor device adapted to detachably couple to an interior structure;

providing a body component of the sensor device including a printed circuit board (PCB) and a power source connected to the PCB, providing an electrical circuit when a substantially central contact element of the base component and a substantially central electrical element of the PCB engage each other;

engaging the contact element and the electrical element such that when the base component and the body component are uncoupled the contact element and the electrical element disengage from each other and an open circuit occurs;

detecting the open circuit using the PCB; and signaling a tamper occurrence when the open circuit is detected.

13. The method of claim 12 further comprising biasing the contact element and the electrical element away from each other such that when the base component and body component are removed from the interior structure in a coupled state the contact element and the electrical element disengage from each other resulting in the open circuit occurring.

14. The method of claim 12 further including receiving the tamper signal at a remote location.

15. The method of claim 12 further including transmitting the tamper signal wirelessly.

* * * * *